United States Patent [19]

Krasnoff

[11] Patent Number: 4,723,387

[45] Date of Patent: Feb. 9, 1988

[54] ABRASIVE-JET CUTTING SYSTEM

[75] Inventor: Eugene L. Krasnoff, Somerville, N.J.

[73] Assignee: Ingersoll-Rand Company, Woodcliff Lake, N.J.

[21] Appl. No.: 915,506

[22] Filed: Oct. 6, 1986

[51] Int. Cl.[4] ..... B24C 7/00

[52] U.S. Cl. ..... 51/410; 51/436; 51/437; 51/438; 83/177; 406/109; 406/120

[58] Field of Search ..... 51/436, 437, 410, 438; 83/177; 406/109, 120, 182; 239/325

[56] References Cited

U.S. PATENT DOCUMENTS

| | | | |
|---|---|---|---|
| 3,746,256 | 7/1973 | Hall et al. | 83/177 |
| 4,037,992 | 7/1977 | Uchida et al. | 406/109 |
| 4,306,387 | 12/1981 | Hopkins et al. | 406/109 |
| 4,381,897 | 5/1983 | Arbeletche et al. | 406/120 |
| 4,642,944 | 2/1987 | Fairhurst et al. | 51/436 |

*Primary Examiner*—E. R. Kazenske
*Assistant Examiner*—Eugenia A. Jones
*Attorney, Agent, or Firm*—B. J. Murphy

[57] ABSTRACT

The novel system discloses both a batch operation and a continuous operation for supplying pressured liquid and a pressured slurry to an abrasive-jet cutting nozzle. In the batch operation, a single vessel for receiving and pressuring slurry is provided and this vessel goes off line, to be recharged with slurry, when it has disgorged its contents to the nozzle. In the continuous operation, a pair of such vessels are provided, and one supplies the nozzle with slurry while the other, having been emptied, is recharged with slurry; valves switch therebetween, to put a re-charged vessel on line, and an emptied one re-charging, to maintain a continuous slurry input for the nozzle.

20 Claims, 2 Drawing Figures

ABRASIVE-JET CUTTING SYSTEM

Figure 1:
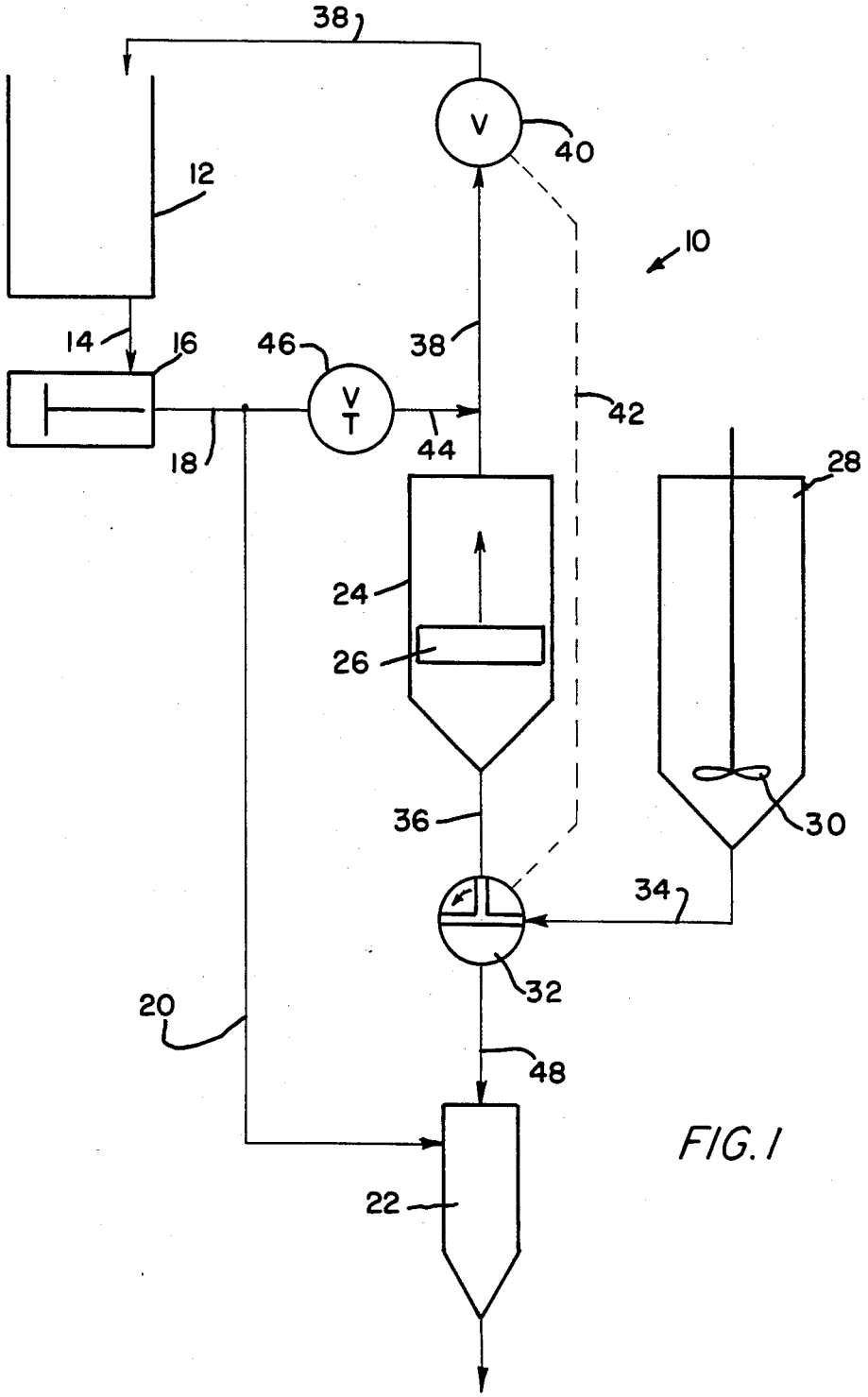

This invention pertains to water-jet cutting systems, and in particular, to such systems which are augmented with an abrasive slurry and, accordingly, are defined as abrasive-jet cutting systems.

In my co-pending patent application, Ser. No. 914062 filed Oct. 1, 1986, and titled "Liquid/Abrasive Jet Cutting Apparatus", I set forth a novel means for producing an efficient abrasive-jet with a customary pump, in lieu of a high-pressure intensifier, and without need for high-pressure lines and fittings. In this instant disclosure, I set forth an abrasive-jet cutting system having a capability for batch operation, and such a system having a capability for continuous operation, for supplying pressured slurry to the jet-cutting nozzle.

It is an object of this invention, then to set forth an abrasive-jet cutting system, comprising first means comprising a supply of pressured liquid; a jet-cutting nozzle; first conduit means for communicating said first means with said nozzle for conducting pressured liquid to said nozzle; second means comprising a reservoir of slurry; third means comprising a given slurry-confining and -pressurizing vessel; second conduit means for communicating said reservoir with said vessel for supplying slurry from said reservoir to said vessel for confinement therein; third conduit means for communicating said first means with said vessel for conducting pressured liquid to said vessel for pressurizing vessel-confined slurry; fourth conduit means for communicating said vessel with said nozzle for conducting pressurized slurry to said nozzle; and a given, single, valve, interpositioned between said vessel, said reservoir, and said nozzle, having means operative in a first mode (a) to effect communication between said vessel and said reservoir, and (b) to prohibit communication between said vessel and said nozzle, and having means operative in a second mode (c) to effect communication between said vessel and said nozzle, and (d) to prohibit communication between said vessel and said reservoir.

It is also an object of this invention to disclose an abrasive-jet cutting system, comprising first means comprising a supply of pressured liquid; a jet-cutting nozzle; first conduit means for communicating said first means with said nozzle for conducting pressured liquid to said nozzle; second means comprising a reservoir of slurry; third means comprising a plurality of slurry-confining and -pressurizing vessels; second conduit means for communicating said reservoir with said vessels of said plurality thereof for supplying slurry from said reservoir to said vessels for confinement therein; third conduit means for communicating said first means with said vessels for conducting pressured liquid to said vessels for pressurizing vessels-confined slurry; fourth conduit means for communicating said vessels with said nozzle for conducting pressurized slurry to said nozzle; and a given, single valve, interpositioned between said vessels, said reservoir, and said nozzle, having means operative in a first mode (a) to effect communication between one of said vessels and said reservoir, and (b) to prohibit communication between said one vessel and said nozzle, and having means operative in a second mode to effect communication between said one vessel and said nozzle, and (d) to prohibit communication between said one vessel and said reservoir.

Figure 2:
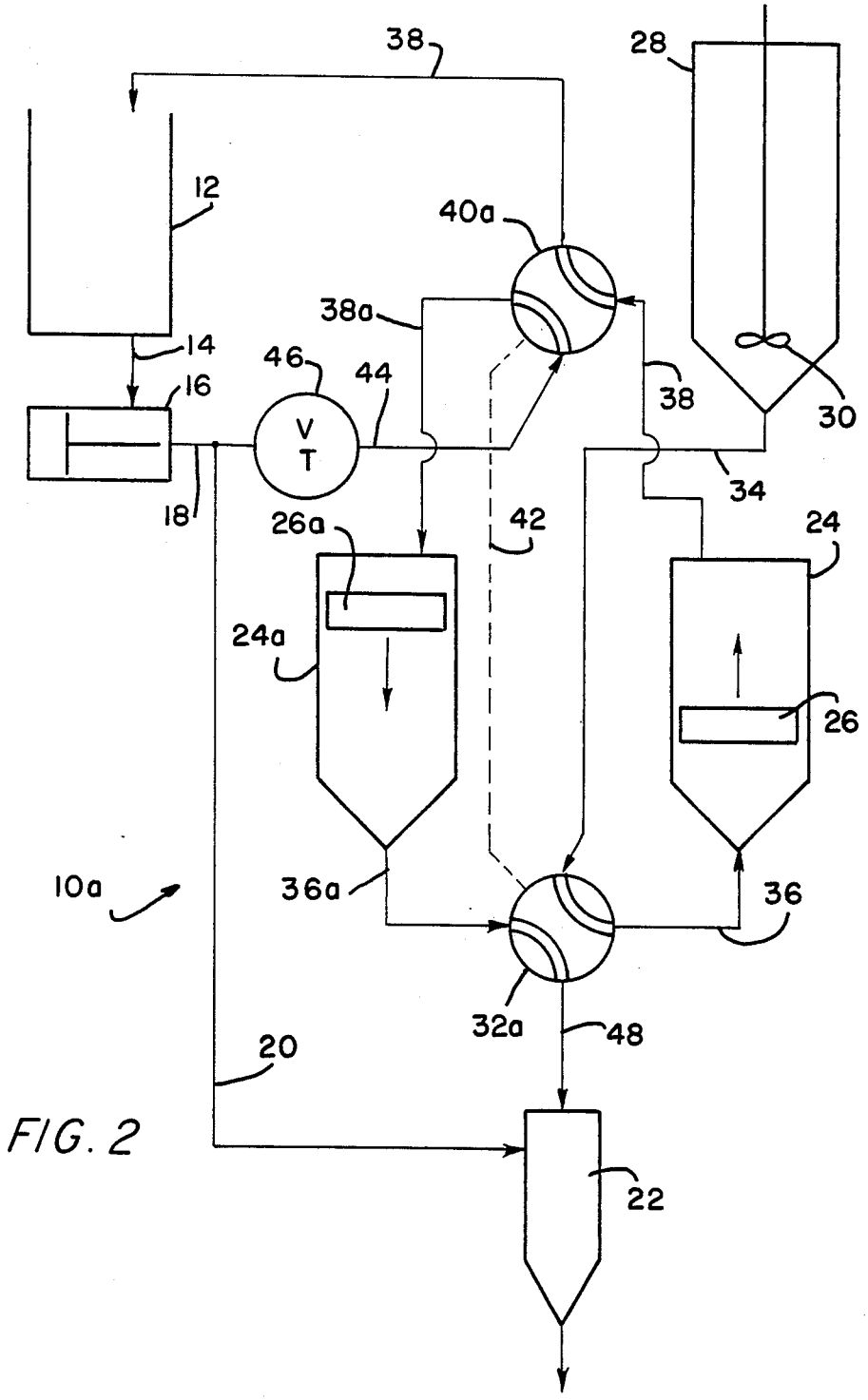

Further objects of this invention, as well as the novel features thereof, will become more apparent by reference to the following description taken in conjunction with the accompanying figures in which:

FIG. 1 is a schematic diagram of the novel system which, in the first embodiment thereof, comprises a batch processing arrangement; and FIG. 2 is a schematic diagram of the novel system which, in this second embodiment thereof, comprises a continuous processing arrangement.

As shown in FIG. 1, the system 10 comprises a tank 12 which comprises a store of water. A tank outlet line 14 supplies water to an intensifier 16 for pressurization of the water. Lines 18 and 20 conduct the pressured water to an abrasive-jet nozzle 22.

A vessel 24 is provided for confining slurry therein, and for pressuring the confined slurry by means of a piston 26 movable therein. A slurry reservoir 28, having an agitator 30 operatively disposed therein, charges the vessel 24 with a supply of slurry when (a) the vessel slurry has been depleted, and (b) the rotary valve 32 is positioned, as shown, to communicate lines 34 and 36.

Vessel 24 has a return line 38 for water to return to the tank, pursuant to a translation of the piston 26 in the arrowed direction (as the vessel 24 is charged with slurry). To accommodate and to prohibit water conduct through line 38, the latter has a control valve 40 interpositioned therein. Valve 40 is kept in its closed position when vessel 24 is being supplied with pressured water from intensifier 16, and is kept in its open position when vessel 24 is being supplied with a new charge of slurry. To insure these conditions, valve 40 is coupled to valve 32, as the dashed linkage 42 signifies, for coincident operation.

As to supplying the vessel 24 with pressured water from pump 16, to pressurize the slurry confined in the vessel, a line 44 communicates with line 18, via a throttle valve 46, for the purpose.

When the vessel 24 is fully charged with slurry from the reservoir 28, valves 32 and 40 are operated; valve 32 is turned ninety degrees to the left (i.e., counterclockwise), to communicate line 36 with a nozzle inlet line 48, and coincidentally valve 40 is shut off. Pressured water, then, enters the vessel 24 to force the piston 26 downwardly (a) to pressurize the slurry in the vessel 24, and (b) to expel slurry therefrom, into the nozzle 22, via line 48. Nozzle 22 is of the same structure as disclosed in my aforecited co-pending patent application.

The aforesaid, then, comprises the system 10 in a batch processing embodiment. In FIG. 2, I depict a continuous processing embodiment of the invention; same or similar index numbers, as employed in FIG. 1, denote same or similar elements and/or components in this FIG. 2.

The FIG. 2 system **10*a* has a pair of vessels 24 and 24*a* which function alternatively. That is, as one of the vessels is being re-charged with slurry from the reservoir 28, the other is supplying pressured slurry to the nozzle 22**.

In this FIG. 2, continuous processing arrangement, valve **32*a*, interpositioned between the reservoir 28, nozzle 22 and vessels 24 and 24*a*, serves a dual function. In the positioning shown, it communicates line 34 with line 36, and communicates line 36*a* with line 48. When turned ninety degrees (in either direction), valve 32*a* communicates line 34 with line 36*a*, and line 36 with line 48**.

The simple open/closed valve in line 38 (in FIG. 1) is now supplanted with a rotary valve **40*a*. Valve 40*a* has two operative positionings, and conducts water therethrough in both. As shown, it communicates fully through line 38, to allow vessel 24 to be re-charged with slurry, and it communicates line 38***a* with line 44 to expel pressured slurry from the vessel 24*a*. In its alternative positioning, valve 40*a* interrupts common flow through both legs of line 38. It connects vessel 24, through one leg of line 38, to line 44, whereby vessel 24 expels pressured slurry to the nozzle 22. Too, in the latter positioning, valve 40*a* communicates line 38*a* with the other leg of line 38 to allow vessel 24*a* to return water to the tank 12.

Valves 32*a* and 40*a*, of course, are ganged for coincident operation via the dashed linkage 42.

While I have described my invention in connection with specific embodiments thereof, it is to be clearly understood that this is done only by way of example and not as a limitation to the scope of my invention as set forth in the objects thereof and in the appended claims.

I claim:

1. An abrasive-jet cutting system, comprising:

first means comprising a supply of pressured liquid;

a jet-cutting nozzle;

first conduit means for communicating said first means with said nozzle for conducting pressured liquid to said nozzle;

second means comprising a reservoir of slurry;

third means comprising a given slurry-confining and -pressurizing vessel;

second conduit means for communicating said reservoir with said vessel for supplying slurry from said reservoir to said vessel for confinement therein;

third conduit means for communicating said first means with said vessel for conducting pressured liquid to said vessel for pressurizing vessel-confined slurry;

fourth conduit means for communicating said vessel with said nozzle for conducting pressurized slurry to said nozzle; and a given, single, valve, interpositioned between said vessel, said reservoir, and said nozzle, having means operative in a first mode (a) to effect communication between said vessel and said reservoir, and (b) to prohibit communication between said vessel and said nozzle, and having means operative in a second mode (c) to effect communication between said vessel and said nozzle, and (d) to prohibit communication between said vessel and said reservoir.

2. An abrasive-jet cutting system, according to claim 1, wherein:

said first means comprises a store of liquid, a liquid pressuring device, and means for conducting liquid from said store to said device.

3. An abrasive-jet cutting system according to claim 2, wherein:

said device comprises an intensifier.

4. An abrasive-jet cutting system according to claim 1, further including:

means interpositioned between said first means and said vessel for selectively controlling flow of pressured liquid from said first means to said vessel.

5. An abrasive-jet cutting system, according to claim 4, wherein:

said flow-controlling means comprises another valve operatively interposed in said third conduit means.

6. An abrasive-jet cutting system, according to claim 2, further including:

fifth conduit means for communicating said vessel with said store for conducting liquid from said vessel to said store.

7. An abrasive-jet cutting system, according to claim 6, further including:

means, interpositioned in said fifth conduit means, selectively operative for opening and closing said fifth conduit means to fluid conduct therethrough.

8. An abrasive-jet cutting system, comprising:

first means comprising a supply of pressured liquid;

a jet-cutting nozzle;

first conduit means for communicating said first means with said nozzle for conducting pressured liquid to said nozzle;

second means comprising a reservoir of slurry;

third means comprising a plurality of slurry-confining and -pressurizing vessels;

second conduit means for communicating said reservoir with said vessels of said plurality thereof for supplying slurry from said reservoir to said vessels for confinement therein;

third conduit means for communicating said first means with said vessels for conducting pressured liquid to said vessels for pressurizing vessels-confined slurry;

fourth conduit means for communicating said vessels with said nozzle for conducting pressurized slurry to said nozzle; and a given, single valve, interpositioned between said vessels, said reservoir, and said nozzle, having means operative in a first mode (a) to effect communication between one of said vessels and said reservoir, and (b) to prohibit communication between said one vessel and said nozzle, and having means operative in a second mode (c) to effect communication between said one vessel and said nozzle, and (d) to prohibit communication between said one vessel and said reservoir.

9. An abrasive-jet cutting system, according to claim 8, wherein:

said given, single valve comprises means operative in said first mode to effect communication between another of said vessels and said nozzle.

10. An abrasive-jet cutting system, according to claim 8, wherein:

said given, single valve comprises means operative in said first mode to prohibit communication between another of said vessels and said reservoir.

11. An abrasive-jet cutting system, according to claim 8, wherein:

said given, single valve comprises means operative in said second mode to effect communication between another of said vessels and said reservoir.

12. An abrasive-jet cutting system, according to claim 8, wherein:

said given, single valve comprises means operative in said second mode to prohibit communication between another of said vessels and said nozzle.

13. An abrasive-jet cutting system, according to claim 8, further including:

means interpositioned between said first means and said vessels for selectively controlling flow of pressured liquid from said first means to said vessels.

14. An abrasive-jet cutting system, according to claim 13, wherein:

said flow controlling means comprises a throttle valve.

15. An abrasive-jet cutting system, according to claim 8, wherein:

said first means comprises a store of liquid, a liquid pressurizing device, and means for conducting liquid from said store to said device.

16. An abrasive-jet cutting system, according to claim 15, further including:

fifth conduit means for communicating said vessels with said store for conducting liquid from said vessels to said store.

17. An abrasive-jet cutting system, according to claim 12, wherein:

said first means comprises a store of liquid, a liquid pressurizing device, and means for conducting liquid from said store to said device.

18. An abrasive-jet cutting system, according to claim 17, further including:

fifth conduit means for communicating said vessels with said store for conducting liquid from said vessels to said store.

19. An abrasive-jet cutting system, according to claim 18, further including:

a control valve, interposed in said fifth conduit means, having means operative, in a given one of two operative modes of said control valve, for (a) effecting communication between one of said vessels and said store, and (b) prohibiting communication between another of said vessels and said store, and having means operative, in the other of said two modes, for (c) effecting communication between said another vessel and said store, and (d) prohibiting communication between said one vessel and said store.

20. An abrasive-jet cutting system, according to claim 19, further including:

means intercoupling said control valve and said given, single valve for causing coincident change of said valves between said operative modes thereof.

* * * * *